US011578486B2

(12) United States Patent
Lang et al.

(10) Patent No.: US 11,578,486 B2
(45) Date of Patent: Feb. 14, 2023

(54) PANEL SYSTEM FOR MODULAR BUILDING CONSTRUCTION

(71) Applicant: Intelligent City Inc., Vancouver (CA)

(72) Inventors: Oliver Lang, Vancouver (CA); Cynthia Wilson, Vancouver (CA); Clayton Blackman, Vancouver (CA); Oliver David Krieg, Vancouver (CA)

(73) Assignee: Intelligent City Inc., Vancouver (CA)

( * ) Notice: Subject to any disclaimer, the term of this patent is extended or adjusted under 35 U.S.C. 154(b) by 0 days.

(21) Appl. No.: 16/973,997

(22) PCT Filed: Jun. 12, 2019

(86) PCT No.: PCT/CA2019/000091

§ 371 (c)(1),
(2) Date: Dec. 10, 2020

(87) PCT Pub. No.: WO2020/227798

PCT Pub. Date: Nov. 19, 2020

(65) Prior Publication Data

US 2021/0123237 A1 Apr. 29, 2021

Related U.S. Application Data

(60) Provisional application No. 62/683,780, filed on Jun. 12, 2018.

(51) Int. Cl.
*E04B 5/48* (2006.01)
*E04B 1/343* (2006.01)

(52) U.S. Cl.
CPC ..... *E04B 5/48* (2013.01); *E04B 1/34321* (2013.01)

(58) Field of Classification Search
CPC ..... E04B 5/48; E04C 2/34; E04C 2002/3488; E04C 2/521; B32B 21/042
See application file for complete search history.

(56) References Cited

U.S. PATENT DOCUMENTS

| | | | | |
|---|---|---|---|---|
| 963,889 | A | 7/1910 | Goodwin | |
| 3,537,223 | A | 11/1970 | Lerchenthal | |
| 4,573,296 | A | 3/1986 | Wrigley | |
| 4,698,945 | A | 10/1987 | Munn | |
| 5,157,892 | A * | 10/1992 | Ryther | E04C 2/36 52/668 |

(Continued)

FOREIGN PATENT DOCUMENTS

| | | | |
|---|---|---|---|
| CA | 1311899 | C | 12/1992 |
| EP | 0460487 | A1 | 12/1991 |
| WO | WO 2013/182997 | A1 | 12/2013 |

*Primary Examiner* — Gisele D Ford
(74) *Attorney, Agent, or Firm* — Morgan, Lewis & Bockius LLP

(57) ABSTRACT

A composite construction element or panel system for use in construction of multi-storey structures, either as a prefabricated panelized system or as a modular system. The composite construction element comprises two mass timber subpanels joined at a distance to form a hollow core, through which various building services (e.g. HVAC or electrical systems) and/or insulation may be integrated. When used as a modular system, after assembly, the two subpanels become one structural entity of increased structural capacity while providing a hollow core to provide/deliver desired building services.

5 Claims, 5 Drawing Sheets

(56) References Cited

U.S. PATENT DOCUMENTS

| | | | | |
|---|---|---|---|---|
| 5,633,053 | A * | 5/1997 | Lockshaw | E04C 2/36 428/33 |
| 6,668,504 | B2 * | 12/2003 | Hughart | E04B 2/7457 181/284 |
| 2010/0146884 | A1 * | 6/2010 | Lu | E04C 2/521 52/220.2 |
| 2010/0325990 | A1 * | 12/2010 | Taraba | E04C 2/525 52/302.1 |
| 2011/0047889 | A1 | 3/2011 | Gad et al. | |
| 2012/0174518 | A1 * | 7/2012 | Litaize | E04C 2/386 52/582.1 |
| 2012/0285116 | A1 * | 11/2012 | Walker | E04B 7/20 52/741.4 |
| 2014/0298745 | A1 | 10/2014 | Rechenmacher et al. | |
| 2015/0337527 | A1 | 11/2015 | Wallance | |
| 2016/0258116 | A1 * | 9/2016 | Penland, Jr. | B32B 21/12 |
| 2016/0332411 | A1 * | 11/2016 | Weissteiner | B27M 3/0026 |
| 2017/0037582 | A1 * | 2/2017 | Penland, Jr. | B32B 7/03 |
| 2017/0275829 | A1 * | 9/2017 | Penland, Jr. | B32B 25/08 |
| 2021/0129504 | A1 * | 5/2021 | Hutchison | B32B 21/08 |

* cited by examiner

PANEL SYSTEM FOR MODULAR BUILDING CONSTRUCTION

CROSS-REFERENCE TO RELATED APPLICATIONS

This application is a National Phase entry of International Patent Application No.: PCT/CA2019/000091, filed Jun. 12, 2019, entitled "Panel System for Modular Building Construction," which claims prior to U.S. Provisional Patent Application No.: 62/683,780, filed Jun. 12, 2018, each of which is hereby incorporated by reference in its entirety.

FIELD OF THE INVENTION

The present invention relates to the field of building construction. More specifically, the present invention relates to the field of prefabricated mass-timber panel systems, particularly for use in the construction of multi-storey structures.

BACKGROUND OF THE INVENTION

Mass timber is increasingly used in prefabricated construction due to the possibility of including surface finishes and services in manufacturing, and the possibility of transporting finished panels or modules to a construction site for quick assembly. A particular benefit is the use of mass timber for the structural system of mid-rise (4-16 storeys) buildings due to its fire ratio and structural strength. Especially voluminous modules, consisting of a floor, a ceiling, and walls, with a high degree of prefabrication, make the construction process more efficient and are therefore considered desirable to manufacturers for certain types of construction projects. Such modules can also allow for a quick building envelope enclosure; among various advantages, this can also reduce the risk of water/weather damage to the structure.

Conventionally, prefabricated modules are transported to a construction site and then stacked on top of each other to await assembly. During this stacking, the floor of each module is stacked upon the ceiling of the module below, thus causing ceilings and floors to be doubled-up. Since the modules have to also support their own weight during transport, storage and assembly, this method usually results in redundant material use, especially since the ceiling and floor from two stacked modules are not structurally connected. Similar redundancy exists for the walls. Accordingly, it is contemplated that there could be significant advantages and cost savings to be had in avoiding such redundancy.

In addition, it is contemplated that a prefabricated panel system, in which said prefabricated panel system is configured to facilitate the provision and distribution of various building "services" (for example, such as: heating, ventilation or air conditioning ("HVAC") services, electrical service distributions, lighting, fire safety equipment, communications services, etc.) may also provide significant advantages.

SUMMARY OF THE INVENTION

In accordance with an aspect of the present invention, disclosed herein is a panel system for use in the construction of modular, multi-storey structures or buildings. In accordance with another aspect of the present invention, disclosed herein is an exemplary construction module employing such a panel system, for use in the construction of modular structures. Also disclosed herein is a method for constructing modular structures by using such construction modules. Also disclosed herein is the use of such a construction panel system in constructing modular structures.

Disclosed herein is a composite construction element for building multi-storey mass timber structures, which construction element is usually prefabricated and then connected and/or finished on the construction site.

Mass timber slabs as conventionally used for prefabricated, multi-storey modular construction, usually consist of one load bearing panel (made from cross-laminated timber ("CLT"), for example) spanning in one or two directions, and a raised floor or a dropped ceiling construction to allow for services to run either above or below the load bearing structure.

In the present panel system, two panels or the equivalent of two adjacent panels in a modularized assembly are structurally connected with spacers at a distance. The components may be made from CLT panels, and strengthening ribs or spacers to achieve truss action, and perimeter glulam beams as needed, all of which may be machined and assembled on or off site to provide sufficient strength to facilitate off-site manufacturing and transportation, in either a panelized or modularized configuration. After final assembly and by fastening the two nested subpanels together, the resulting strength is equivalent to the required building strength, thus maximizing structural effectiveness.

The panels can be configured to provide service (e.g. HVAC) access locations and fire proofed cavities. The lower subpanel, which will act as the ceiling of the modular unit in the final assembly, also ensures fire separation.

In accordance with one aspect of the present invention, disclosed herein is a prefabricated panel system for use in constructing a floor for a multi-storey structure comprising: (i) an upper subpanel provided with a plurality of downwardly extending spacers affixed thereto; (ii) a lower subpanel provided with a plurality or upwardly extending spacers affixed thereto; wherein, when the upper subpanel is disposed atop the lower subpanel, the downwardly extending spacers and the upwardly extending spacers are configured, along with the lower subpanel and upper subpanel, to define at least one void space disposed between the upper subpanel and the lower subpanel; (iii) a service channel, disposed within the void space; and (iv) a building service preinstalled within the service channel.

In another aspect, at least one of the plurality of downwardly extending spacers matingly cooperates with at least one of the plurality of upwardly extending spacers in order to achieve truss action therebetween. In another aspect, building service may include: wiring for electricity; wiring for lighting; a heating, ventilation or air conditioning system; underfloor heating; a sprinkler system; fire fighting and detection equipment; a communications service (wired internet, cable or phone service); and sensors. In another aspect, the downwardly extending spacers or the upwardly extending spacers are configured with one or more orifices to allow access to the service channel for purposes facilitating installation or maintenance of the building service. In another aspect, the panel system is substantially made from mass timber.

In accordance with another aspect of the present invention, disclosed herein is a modular panel system for use in constructing modular units of a multi-storey structure, the modular panel system comprising: (i) a lower subpanel provided with a plurality of downwardly extending spacers affixed thereto; (ii) an upper subpanel provided with a plurality or upwardly extending spacers affixed thereto; and (iii) a plurality of elongate framing studs, each framing stud having an upper end and a lower end, wherein the lower end of each of the plurality of framing studs is disposed at or proximate to the perimeter of the lower subpanel, wherein each of the plurality of framing studs is affixed at its lower end to the lower subpanel, wherein the upper end of each of the plurality of framing studs is disposed at or proximate to the perimeter of the upper subpanel, and wherein each of the plurality of framing studs is affixed at its upper end to the upper subpanel, and wherein the modular panel system is configured to be installed atop a second modular panel system, the second modular panel system comprising: (i) a second lower subpanel provided with a plurality of second downwardly extending spacers affixed thereto; (ii) a second upper subpanel provided with a plurality or second upwardly extending spacers affixed thereto; and (iii) a plurality of elongate second framing studs, each second framing stud having an upper end and a lower end, wherein the lower end of each of the plurality of second framing studs is disposed at or proximate to the perimeter of the second lower subpanel, wherein each of the plurality of second framing studs is affixed at its lower end to the second lower subpanel, wherein the upper end of each of the plurality of second framing studs is disposed at or proximate to the perimeter of the second upper subpanel, and wherein each of the plurality of second framing studs is affixed at its upper end to the second upper subpanel, and wherein the lower subpanel, the downwardly extending spacers of the lower subpanel, the second upper panel of the second modular panel system and the second upwardly extending spacers of the second upper panel, are configured to define at least one void space disposed between the lower subpanel and the second upper subpanel, the void space defining a service channel therein, within which a building service may be installed.

In another aspect, at least one of the plurality of downwardly extending spacers matingly cooperates with at least one of the plurality of second upwardly extending spacers in order to achieve truss action therebetween. In another aspect, the building service may include: wiring for electricity; wiring for lighting; a heating, ventilation or air conditioning system; underfloor heating; a sprinkler system; fire fighting and detection equipment; a communications service (wired internet, cable or phone service); and sensors. In another aspect, the downwardly extending spacers or the second upwardly extending spacers are configured with one or more orifices to allow access to the service channel for purposes facilitating installation or maintenance of the building service. In another aspect, disclosed herein is a multi-storey structure constructed from a plurality of such modular panel systems. In another aspect, disclosed herein is the use of such modular panel system in constructing a modular multi-storey structure.

DETAILED DESCRIPTION OF THE INVENTION

A detailed description of one or more embodiments of the present invention is provided below along with accompanying figures that illustrate the principles of the invention. As such, this detailed description illustrates the present invention by way of example and not by way of limitation. The description will clearly enable one skilled in the art to make and use the invention, and describes several embodiments, adaptations, variations and alternatives and uses of the invention, including what is presently believed to be the best mode and preferred embodiment for carrying out the invention. It is to be understood that routine variations and adaptations can be made to the invention as described, and such variations and adaptations squarely fall within the spirit and scope of the invention. For the purpose of clarity, technical material that is known in the technical fields related to the invention has not been described in detail so that the invention is not unnecessarily obscured.

Disclosed herein is a composite construction element for use in building multi-storey mass timber structures, which construction elements are usually prefabricated and then connected and/or finished on the construction site. As disclosed herein, the construction elements are generally contemplated as being made from mass timber, although it is to be understood that the construction elements may also be made from mass timber combined with other construction materials, or from other building materials or combinations thereof. It is contemplated that the composite construction element may be utilised either as a prefabricated panel system (sometimes referred to herein as the "panelized system") or as a "modular system" (where prefabricated modules of units may be assembled together).

Figure 1:
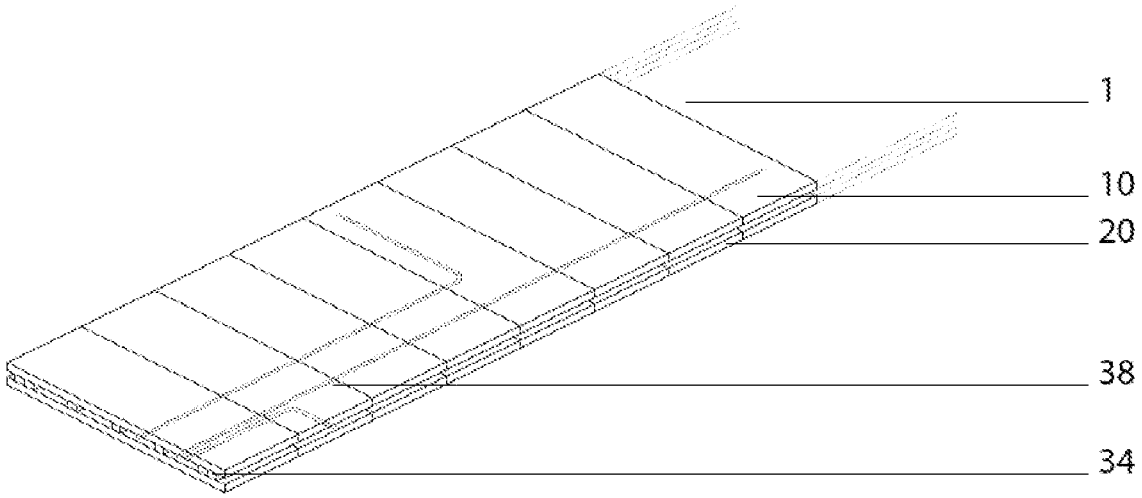
FIG. 1 is a perspective view of an exemplary embodiment of the panel system of the present invention.

Referring to FIG. 1, this illustrates an exemplary embodiment of the panel system of the present invention. This panel system may be used as a panellized system or a modular system.

A panel system 1 is illustrated in an assembled form. The panel system 1 comprises an upper subpanel 10 and a lower subpanel 20. When the panel system 1 has been installed (at a building), the upper panel 10 is secured to the lower subpanel 20. Between the upper subpanel 10 and lower subpanel 20, are provided a plurality of strengthening ribs or spacers 32 (as may be more clearly seen in FIG. 2).

Where the panel system 1 is to be installed for a multi-storey building and used in the orientation as shown, the bottom surface of the lower subpanel 20 would become the ceiling of a lower floor, while the top surface of the upper subpanel 10 would become the floor of the floor above. Although the present invention is illustrated herein as a pair of subpanels, each of which when assembled together, extend in the horizontal plane so as to form the ceiling of a lower unit and the floor of a unit thereabove, and it is contemplated that this is a preferred manner of utilising the disclosed panel system, it is nevertheless to be understood that the panel system may also be adapted for use in other orientations, for example as a panel system which extends in a vertical plane (i.e. so that the assembled pair of subpanels form the side walls between adjacent units).

Figure 2:
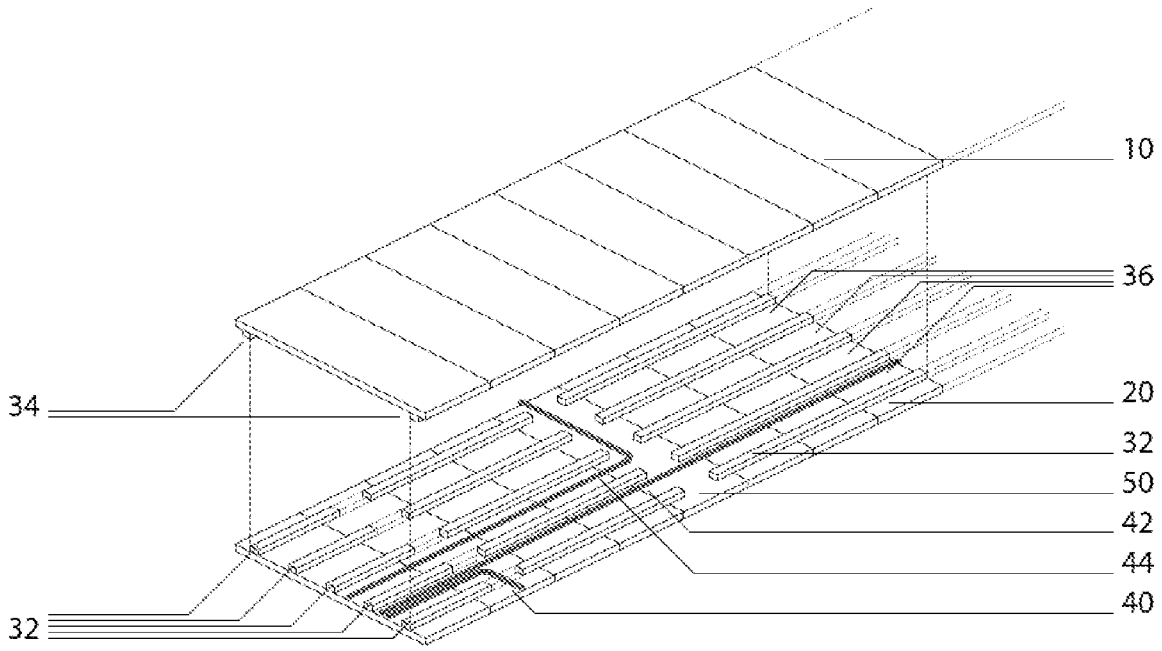
FIG. 2 is an exploded, perspective view of the panel system in accordance with one aspect of the present invention.
Figure 3:
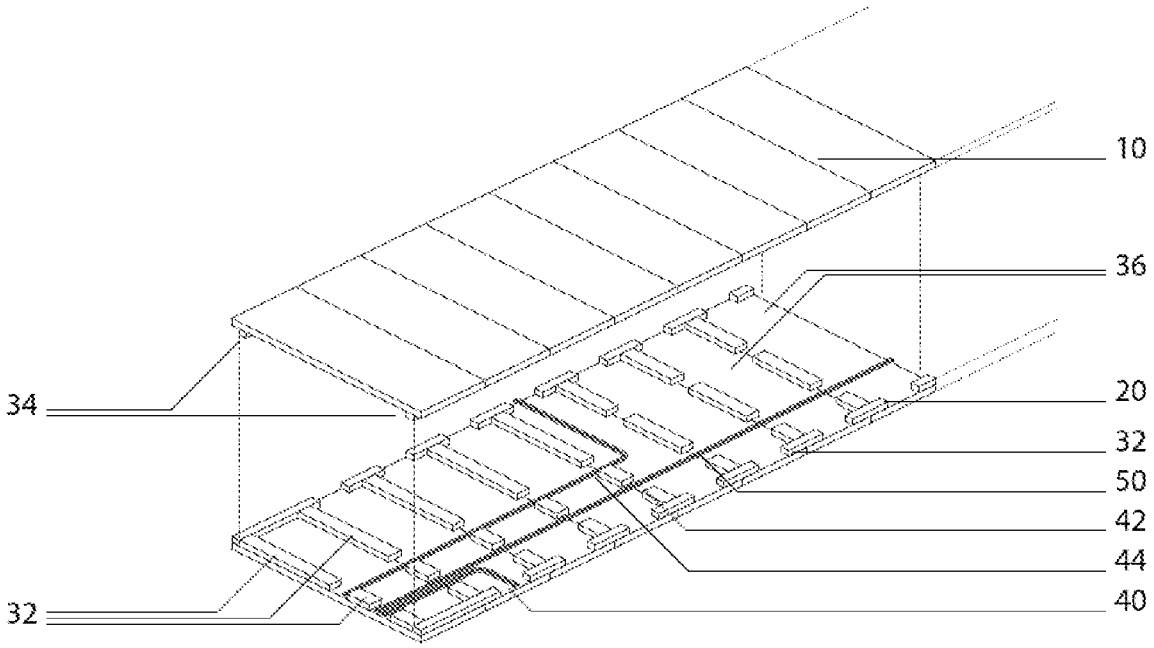
FIG. 3 is an exploded, perspective view of the panel system in accordance with another aspect of the present invention.

FIG. 2 is an exploded view of the panel system of FIG. 1. The spacers 32, 34 define a hollow core between the upper subpanel 10 and lower subpanel 20, comprising one or more void spaces 36. As described in more detail below, some of the void spaces 36 define one or more service channels, which may be used to provide, deliver or distribute various building services (of the sort typically contemplated, such as HVAC systems) to the building units. The spacers 32, 34 also serve to provide structural support between the upper and lower subpanels 10, 20. In the configuration illustrated in FIG. 2, the spacers run parallel to each other, substantially along the length of the subpanels in a lengthwise direction. Other configurations and orientations of the spacers are of course possible, and would be apparent to one skilled in the art, as considered appropriate. (For example, the spacers may run parallel to each other, substantially along the subpanel in a widthwise direction, or the spacers may run only partly along the length of the subpanel. Alternatively, the spacers may be configured to extend in more than one direction; for example, in a lengthwise direction for a section of the subpanel, and then in a widthwise direction for another section of the panel, etc.). FIG. 3 is an exploded view illustrating an alternative embodiment of the panel system, showing a different configuration and orientation for the spacers 32.

In the embodiments shown in FIG. 2 and FIG. 3, a plurality of spacers 34 are attached to the upper subpanel 10, and extend in a downward direction. A plurality of spacers 32 are attached to the lower subpanel 20, and extend in an upward direction. Downwardly extending spacers 34 are configured to correspond with the upwardly extending spacers 32, such that they cooperate together to achieve a truss action, which helps secure the upper subpanel 10 to the lower subpanel 20.

The hollow core formed between the upper subpanel 10 and the lower subpanel 20, comprising a plurality of void spaces 36 defined by the spacers 32 and 34, may be used to provide or distribute one or more of a broad range of "services" to and within the building, and/or provide access locations to such services. A service may be as simple as electrical wiring or a HVAC vent system (for the unit or for the building). As used herein, such services can include, for example: acoustics, insulation and devices to distribute ventilation, underfloor heating, sprinkler systems, fire fighting and detection equipment, electrical service distributions, lighting, communications services (e.g. wired internet, cable or phone services), and sensors (for safety, for security, diagnostic systems, etc.). In addition, the void spaces may also be used to provide fire separation for fire-proofing purposes; to act as an air gap; to be insulated for insulation purposes; to provide sound-proofing; etc., as the case may be. As shown in FIG. 2 and FIG. 3, the panels/spacers may be configured to provide service access locations. Various services 40, 42, 44 may be distributed through the hollow core to various parts of the module or building as required. In addition, the panel system may be configured to provide openings so as to allow access to the service line (e.g. an HVAC system) for maintenance purposes. One or more of the spacers 32, 34 may be provided with one or more spacer gaps 50 to allow the various services to be suitably distributed as required, whether within the building unit or within the constructed building as a whole. Such spacer gaps 50 may come prefabricated on the panel system, or they may be provided as required during installation of the services (e.g. by cutting/drilling out or removing sections of the spacers 32, 34. Optionally, once the services have been installed within the panel system, the remaining void spaces 36 may insulated, if desired.

Figure 4:
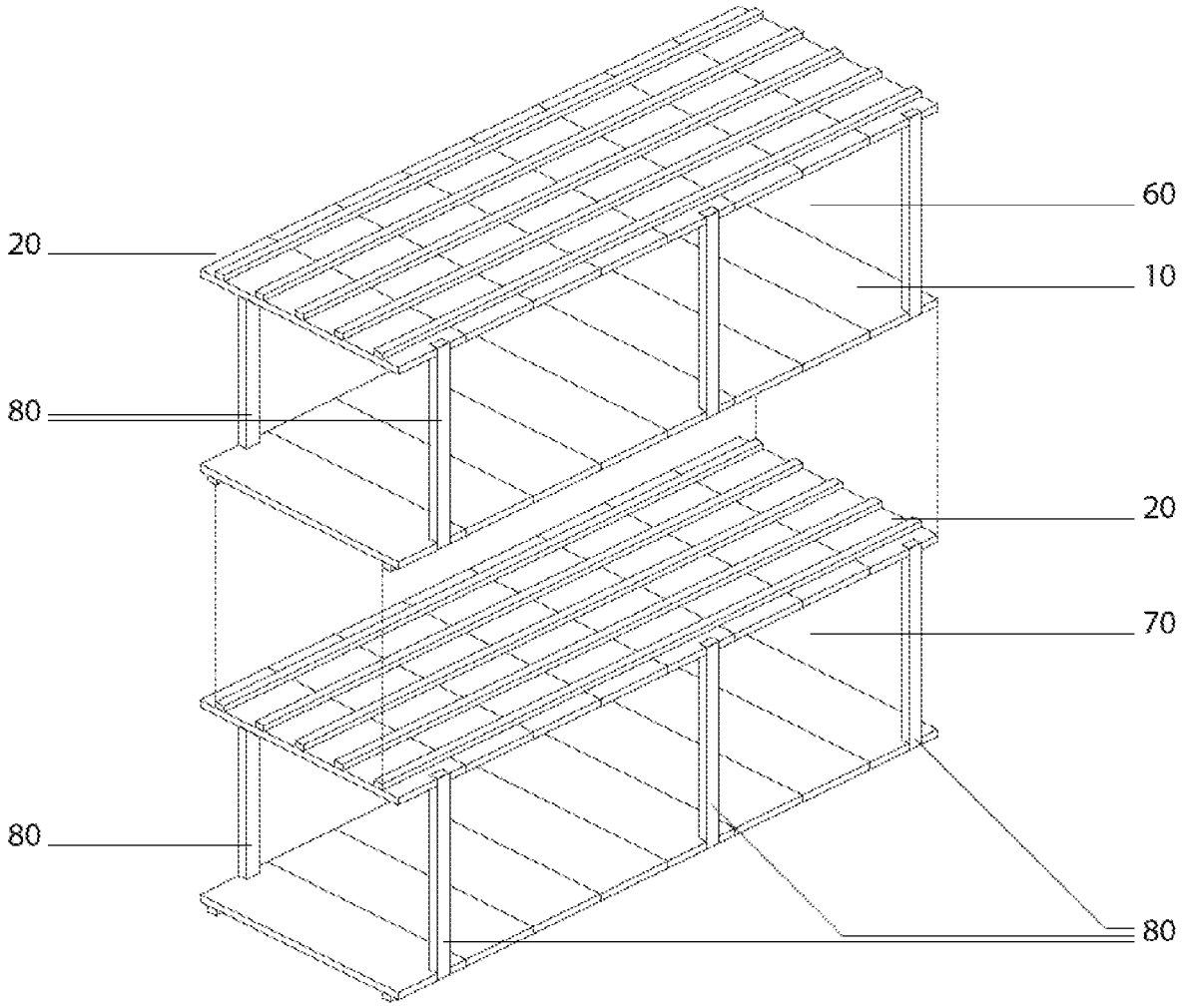
FIG. 4 is a partially-exploded perspective view of two stacked construction modules in accordance with an aspect of the present invention.

Referring to FIG. 4, this illustrates the panel system 1 as used for a modular system. This shows a partially exploded view of two stacked construction modules in accordance with an aspect of the present invention. An upper module 60 is shown, which is to be stacked atop a lower module 70. The upper and lower modules may then be assembled together to form a lower and upper storey unit (or partial unit) in a modular structure/building. Each module may form a unit or part of a unit in a multi-storey modular building. Each module comprises: an upper subpanel 10 (which will actually form the floor of the unit) which is configured with a plurality of downwardly extending spacers as previously described; a lower subpanel 20 (which will actually form the ceiling of that unit) which is configured with a plurality of upwardly extending spacers as previously described; and a plurality of framing studs 80. The framing studs 80 are affixed to the upper subpanel 10 at their lower end, and are affixed to the lower subpanel 20, thereby forming the frame of a module. The upper subpanel 10 of the upper module 60 (which is actually situated at the lower portion of the upper module 60) may be stacked onto the lower subpanel 20 of the lower module 70 (which is actually situated at the upper portion of the lower module 70), using their respective spacers to engage together to achieve a truss action, and are secured together. In the same manner as previously described, the upper subpanel 10 of the upper module 60, and the lower subpanel 20 of the lower module 70 may be secured together to form a composite panel system, between the two modules.

It is contemplated that some or all of the spacers 32, 34 for the respective subpanels may be installed thereon at the construction site, during assembly of the panel system and modules. Alternatively, the spacers 34 for the upper subpanel 10 and the spacers 32 for the lower subpanel 20 may all be prefabricated and affixed to their respective subpanels off-site, before being transported to the construction site for assembly. Alternatively, the spacers 32 and the lower subpanel 20 may be prefabricated, with the spacers 32 being affixed to the lower subpanel 20 off-site, but the spacers 34 for the upper subpanel 10 may be installed at the construction site, during assembly. Alternatively, the spacers 34 and the upper subpanel 10 may be prefabricated, with the spacers 34 being affixed to the upper subpanel 10 off-site, but the spacers 32 for the lower subpanel 10 may be installed at the construction site, during assembly.

During final assembly of the modular units, the two nested subpanels are affixed and secured together, with the resulting strength of the composite panel system being equivalent to that required by the building strength.

In the same manner as discussed above, some of the hollow core or void spaces formed between the upper subpanel 10 of the upper module, and the lower subpanel 20 of the lower submodule, may be used to provide one or more services to and within the building, and/or access locations to such services. For the modular system, the services may be installed at the construction site, during the assembly of stacked modules. Alternatively, any services may be wholly or partially prefabricated during manufacturing for convenient assembly at the construction site.

Figure 5:
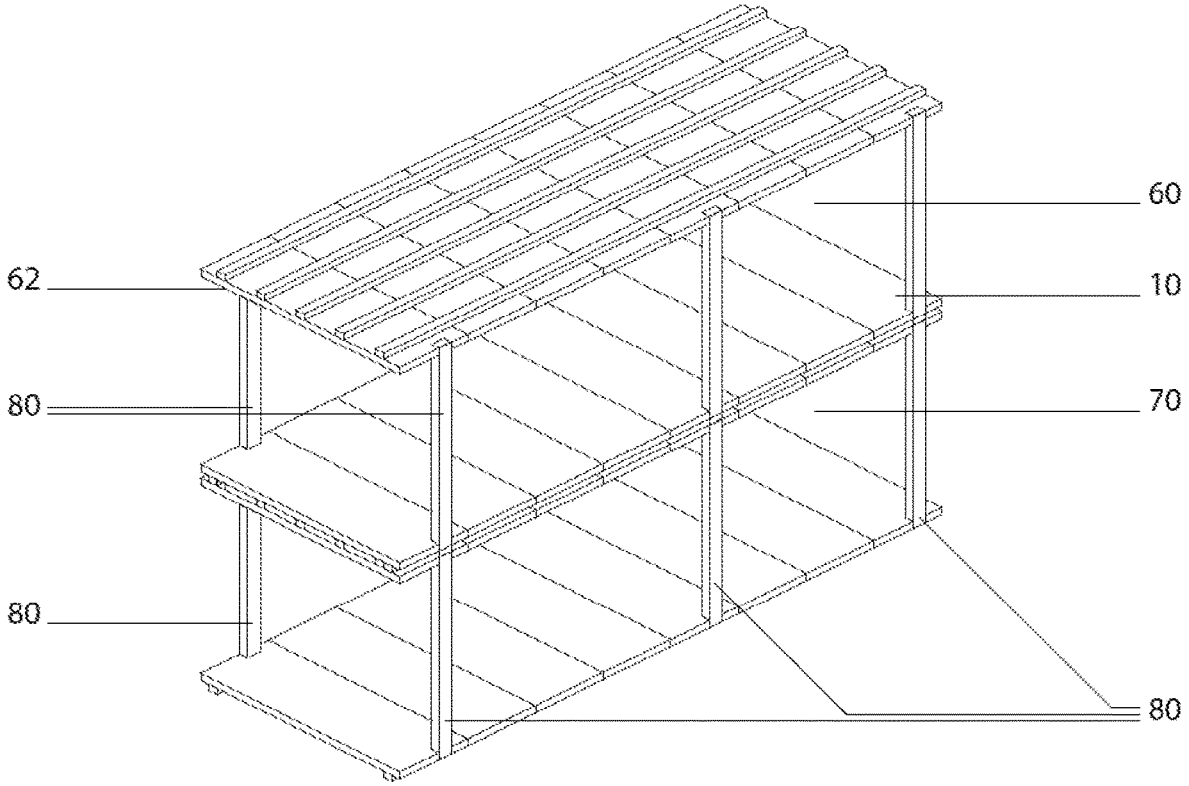
FIG. 5 is a perspective view of two stacked construction modules, in accordance with an aspect of the present invention, shown assembled together.

FIG. 5 illustrates the two stacked construction modules, shown assembled together. When the two construction modules are so assembled together, the lower module 70 and upper module 60 each may define a space corresponding to one whole unit or a portion of a unit within a multi storey building. For example, lower module 70 may represent one single residential or commercial unit, while upper module 60 represents another single residential or commercial unit disposed in a floor above. It is to be understood that multiple construction modules may be stacked and assembled on top of each other to form units on multiple storeys. Furthermore, although not specifically illustrated, multiple construction modules may also be disposed and assembled adjacent to each other in order to form multiple units on the same floor (i.e. neighboring modules) or to form multi-module units.

When the panel system 1 is used as a panelized system, the panel system is generally contemplated to be prefabricated. The lower subpanel 20 is provided with a plurality of upwardly extending spacers 32, and a corresponding upper panel 10 is provided with two or more downwardly extending spacers 34. The downwardly extending spacers 34 are configured to correspond with the upwardly extending spacers 32, such that they cooperate together to achieve a truss action, which helps secure the upper subpanel 10 to the lower subpanel 20. The spacers 32, 34 define a hollow core between the upper subpanel 10 and lower subpanel 20, comprising one or more void spaces 36. The void spaces 36 define one or more service channels, which may be used to provide, deliver or distribute various building services within the unit when it has been assembled or within the assembled building. In the panelized system, the set of corresponding subpanels, and the building service or services contained within the service channels of such subpanels come prefabricated and are manufactured off site. The composite panelized system may then be conveniently installed on the construction site, complete with provision of an applicable building service as required.

The invention claimed is:

1. A modular system for use in constructing modular units of a multi-storey structure, the modular system comprising:

a first modular panel system comprising:

a first lower subpanel, the first lower subpanel provided with a first plurality of downwardly extending spacers affixed thereto;

a first upper subpanel, the first upper subpanel provided with a first plurality of upwardly extending spacers affixed thereto; and a first plurality of elongate framing studs, each elongate framing stud in the first plurality of elongate framing studs having an upper end and a lower end, wherein the lower end of each elongate framing stud of the first plurality of elongate framing studs is disposed at or proximate to a first perimeter of the lower subpanel, wherein each elongate framing stud of the first plurality of elongate framing studs is affixed at the lower end to the lower subpanel, wherein the upper end of each elongate framing stud of the first plurality of elongate framing studs is disposed at or proximate to a second perimeter of the upper subpanel, and wherein each elongate framing stud of the first plurality of elongate framing studs is affixed at the upper end to the upper subpanel; and a second modular panel system, wherein the first modular panel system is configured to engage with the second modular panel system, the second modular panel system comprising:

a second lower subpanel provided with a second plurality of downwardly extending spacers affixed thereto;

a second upper subpanel provided with a second plurality of upwardly extending spacers affixed thereto; and a second plurality of elongate framing studs, each elongate framing stud in the second plurality of elongate framing studs having an upper end and a lower end, wherein the lower end of each elongate framing stud of the second plurality of elongate framing studs is disposed at or proximate to a third perimeter of the second lower subpanel, wherein each elongate framing stud of the second plurality of elongate framing studs is affixed at the lower end to the second lower subpanel, wherein the upper end of each elongate framing stud of the second plurality of elongate framing studs is disposed at or proximate to a fourth perimeter of the second upper subpanel, and wherein each elongate framing stud of the second plurality of elongate framing studs is affixed at the upper end to the second upper subpanel, wherein the first lower subpanel, the first plurality of downwardly extending spacers of the first lower subpanel, the second upper panel, and the second plurality of upwardly extending spacers of the second upper panel are configured to define at least one void space disposed between the first lower subpanel and the second upper subpanel, the at least one void space defining a service channel therein, wherein a building service is installed within the service channel of the at least one void space, wherein the building service is selected from the group consisting of: wiring for electricity; wiring for lighting; a heating, ventilation or air conditioning system; underfloor heating; a sprinkler system; fire fighting and detection equipment; a communications service; and a plurality of sensors; and wherein the first modular panel system and the second modular panel system are substantially made from mass timber.

2. The modular panel system of claim 1, wherein at least one downwardly extending spacer of the first plurality of downwardly extending spacers matingly cooperates with at least one upwardly extending spacer of the second plurality of upwardly extending spacers in order to achieve truss action therebetween.

3. The panel system of claim 1, wherein the first plurality of downwardly extending spacers or the second plurality of upwardly extending spacers is configured with one or more orifices to allow access to the service channel for purposes of facilitating installation or maintenance of the building service.

4. A multi-storey structure constructed from the modular system as described in claim 1.

5. The modular system of claim 1, wherein the first modular panel system is configured to be installed atop the second modular panel system.

* * * * *